US005698510A

United States Patent [19]

Wilkinson et al.

[11] Patent Number: 5,698,510

[45] Date of Patent: Dec. 16, 1997

[54] PROCESS FOR MAKING GRANULAR DETERGENT COMPOSITIONS COMPRISING NONIONIC SURFACTANT

[75] Inventors: Carole Patricia Wilkinson, Lxelles; Paul Amaat Raymond France, Kessel-Lo, both of Belgium; John Christian Schmitt, Euskirchen Kirchheim, Germany

[73] Assignee: The Procter & Gamble Company, Cincinnati, Ohio

[21] Appl. No.: 612,946

[22] PCT Filed: Sep. 1, 1994

[86] PCT No.: PCT/US94/10062

§ 371 Date: Mar. 12, 1996

§ 102(e) Date: Mar. 12, 1996

[87] PCT Pub. No.: WO95/07968

PCT Pub. Date: Mar. 23, 1995

[30] Foreign Application Priority Data

Sep. 13, 1993 [EP] European Pat. Off. ..... 93870187.7
Apr. 21, 1994 [EP] European Pat. Off. ..... 94201094.3

[51] Int. Cl.[6] ..... C11D 11/00

[52] U.S. Cl. ..... 510/444; 510/451; 510/350; 510/351; 510/356; 510/502

[58] Field of Search ..... 510/444, 501, 510/451, 502, 351, 350, 356

[56] References Cited

U.S. PATENT DOCUMENTS 5,364,575 11/1994 Doom, Sr. et al. ..... 264/50
5,366,652 11/1994 Capeci et al. ..... 252/89.1
5,468,516 11/1995 Yamashita et al. ..... 510/444
5,529,715 6/1996 Kuroda et al. ..... 510/444

FOREIGN PATENT DOCUMENTS 0 265 203 A1 4/1988 European Pat. Off. ..... C11D 1/83
0 358 474 B1 3/1990 European Pat. Off. ..... C11D 3/37
0 544 492 A1 6/1993 European Pat. Off. ..... C11D 17/06
0544492 6/1993 European Pat. Off. .
06220498-A 8/1994 Japan ..... C11D 17/06
92/06160 4/1992 WIPO ..... C11D 1/835

*Primary Examiner*—Douglas J. McGinty
*Assistant Examiner*—Lorna M. Douyon
*Attorney, Agent, or Firm*—Jacobus C. Rasser; Jerry J. Yetter; Ken K. Patel

[57] ABSTRACT

A process for making granular detergent compositions or components comprising from about 35% to about 85% by weight of a surfactant system comprising a mixture of polyhydroxy fatty acid amide and ethoxylated nonionic surfactant. The surfactant system is in the solid phase at temperatures of 25° C. and below, and has a softening point from above 25° C. to 100° C. Additionally, the surfactant system has a viscosity profile whereby its viscosity is at least about 20,000 cps at a temperature of 10° C. above the softening point, and less than about 10,000 cps at a temperature of 30° C. above the softening point, all viscosities being measured at a shear rate of 25 $s^{-1}$. The process comprises the steps of: a) pumping the surfactant system in its low viscosity state; b) cooling the surfactant system to a temperature where its viscosity is increased to at least about 20,000 cps; c) granulating the surfactant system in the presence of a finely divided powder to obtain agglomerates; and d) cooling the agglomerates.

12 Claims, No Drawings

PROCESS FOR MAKING GRANULAR DETERGENT COMPOSITIONS COMPRISING NONIONIC SURFACTANT

FIELD OF THE INVENTION

The present invention is concerned with granular detergent components or compositions which are rich in high performance nonionic surfactants. The compositions are based upon specified surfactant systems and processes which make it possible to produce very high surfactant active components.

BACKGROUND OF THE INVENTION

Nonionic surfactants are important components of current laundry detergent compositions. Present trends demand particulate components or compositions which have a high bulk density and which have a high level of nonionic surfactant. The particulate must have good physical characteristics, and must deliver nonionic surfactants which have been selected for high performance in to the wash. Various prior art attempts have been described which approach these demands from different perspectives. For example:

EP544492, published on 2nd Jun., 1993, discloses particulate high density detergent composition comprising 15 to 50% of a mixed anionic/nonionic surfactant system. The nonionic surfactants chosen are ethoxylated alcohols having a peaked ethoxylation distribution with an average of about 3 to 6.5. Although fatty acid soaps are suggested as suitable structurants which modify the surfactant viscosity profile, the resulting granules where soap is used (in Examples 16 to 19, 24 to 29) have surfactant activities of 29 to 32.5%.

WO9206160, published on 16th Apr., 1992, discloses high performing nonionic surfactant systems based on mixtures of glucose amides and ethoxylated nonionic surfactants. In one example (example 20) a component is described which comprises a nonionic surfactant system which is a mixture of 20% Dobanol (Trade Name) EO3 and 80% N-methyl glucose amide in aqueous solution. EP364881, published on 25th Apr. 1990, describes gels formed from polyglycol ether derivatives and water in ratios of from 5:1 to 1:2. The gels are formed into free-flowing granulates by mixing with finely divided solids.

The problem addressed by the present invention concerns the need to provide high density particulate laundry detergent which has a high nonionic surfactant content, and which does not cake or lump upon storage, even in hot, humid conditions, and which dissolves and disperses rapidly upon contact with water, even cold water, to give a high detergency performance on the washing load.

Whilst the prior art provides some guidance as to how each of these objectives might be independently achieved, there does not appear to be a solution to all of the aspects of the problem provided by any one reference.

The present invention provides a nonionic, or mixed nonionic/anionic, surfactant system having a specific viscosity profile which can be formed into a solid particulate which does not cake during storage, which dissolves rapidly and has an excellent performance profile.

SUMMARY OF THE INVENTION

In a first aspect, the present invention concerns a granular detergent composition or component having a bulk density of at least 650 g/l, comprising a surfactant system wherein said composition or component comprises from 35% to 85% by weight of nonionic surfactant and wherein said surfactant system is substantially in the solid phase at temperatures of 25° C. and below, and that said surfactant system has a softening point above 25° C. and wherein the surfactant system has a viscosity profile whereby the viscosity of the surfactant system is at least 20000 cps at a temperature of 10° C. above the softening point, and less than 10000 cps at a temperature of 30° C. above the softening point, all viscosities being measured at a shear rate of 25 $s^{-1}$.

In a second aspect the present invention concerns specific combinations of the nonionic surfactant containing particle with other detergent components to produce a finished laundry detergent composition.

In a third aspect the present invention concerns a process for the manufacture of nonionic surfactant containing particles of the present invention.

DETAILED DESCRIPTION OF THE INVENTION

It has now been found that high surfactant activities can be achieved if an agglomeration "window" exists within which the surfactant system has a high viscosity. Typically this may be achieved by appropriate selection of nonionic surfactants such that there is a "window" of at least 10° C., the lower limit of which is the softening point of the surfactant system, within which the system has a viscosity of at least 20000 cps, preferably 25000 to 50000 cps.

However, in order to be able to prepare, handle, store and transport the surfactant system it should have a viscosity of less than 10000 cps at a temperature of 30° C. above the softening point.

High activities and good caking properties can only be achieved if the surfactant system has a softening point above ambient temperature, e.g. above 25° C., preferably above 40° C.

Good rates of solubility can be correlated with the softening point of the surfactant system. Surfactant systems having a softening point of greater than 100° C. (e.g. "pure" C16 N-methyl glucosamide) tend to show poor rates of solubility. Preferably the softening point of the surfactant system will be less than 80° C.

It is preferred that the surfactant system of the present invention has a softening point which lies within the range of from 40° C. to 100° C., and furthermore that the surfactant system has a viscosity profile whereby the viscosity of the surfactant system is from 25000 to 50000 cps at a temperature of 10° C. above the softening point.

The surfactant system may be comprised entirely of nonionic surfactants or, preferably, it will be a mixed anionic/nonionic surfactant system. In either case the surfactant system preferably comprises more than 40% by weight, and more preferably more than 50% by weight of nonionic surfactant. Where anionic surfactant is present in the surfactant system the ratio of anionic to nonionic surfactant should be from 1:100 to 1:1.

Where the surfactant system is exclusively nonionic surfactant it is often possible to exclude water completely. However when anionic surfactants are present these will often be used in the form of a concentrated paste, or, more preferably, in the form of a hydrated or moisture containing powder. The surfactant system should have a water component of less than 15%, preferably less than 10% by weight, and most preferably less than 5% by weight of the surfactant system.

Preferred nonionic surfactants may be selected from the families of ethoxylated nonionic surfactants, glycerol ethers, glucosamides, glycerol amides, glycerol esters, fatty acids, fatty acid esters, fatty amides, alkyl polyglucosides, alkyl polyglycol ethers, polyethylene glycols, ethoxylated alkyl phenols and mixtures thereof. A highly preferred surfactant system comprises a mixture of polyhydroxy fatty acid amide and an ethoxylated nonionic surfactant in the ratio of from 3:7 to 7:3.

Finished laundry detergent compositions may be prepared by mixing or blending the nonionic containing particles with:

a) a component which comprises at least 40% by weight of anionic surfactant; and b) a component which comprises at least 70% by weight of a builder material. Preferably each of these major components is present at a level of from 3% to 40% by weight of the finished component. More preferably component (b) is present at a level of from 3% to 20% by weight of the finished composition.

The nonionic surfactant containing particles of the present invention may be prepared by:

a) pumping a surfactant system in its low viscosity state;

b) cooling said nonionic surfactant to a temperature where its viscosity is increased to at least 20000 cps;

c) granulating the surfactant in the presence of a finely divided powder;

d) cooling said agglomerates.

The cooling step (b) is preferably performed using a high pressure scraped surface heat exchanger.

The term "surfactant system" as used herein means a mixture of one or more surfactants comprising nonionic surfactants alone or a mixed anionic/nonionic surfactant system. Whilst other components such as water and solvents (e.g. short chain alcohols) may be present in the surfactant system, these will generally be minimised and preferably excluded.

The term "softening point" as used herein means the temperature at which the surfactant system passes between the solid and mixed solid/liquid phases. The softening point can be identified by using a differential scanning calorimetry (DSC) curve. The curve is a plot of true specific heat capacity against temperature. The softening point is the temperature at which enthalpy of melting is greater than zero. This is the temperature at which phase change begins to occur when the solid surfactant system is heated.

The term "viscosity" as used herein means the viscosity measured at a shear rate of 25 $s^{-1}$. The viscosity can be measured by rotational analysis (e.g. a rheometer). Suitable instruments for these measurements are manufactured by Physica Messtechnik, Germany, (supplied by Thermo Instrument Systems of Breda, Netherlands).

The term "high active" as used herein refers to nonionic surfactant activities of at least 35% by weight of the particulate component or composition, preferably greater than 40% by weight, and more preferably about 50% by weight.

The various aspects of the invention will now be described in more detail.

Surfactant Systems

In order to provide a surfactant system which fulfils all of the physical requirements (ie the viscosity profile) of the present invention, it will usually be necessary to blend two or more compatible nonionic surfactants to give the required properties. For example, a homogeneous mixture of a high melting point surfactant with a low melting point surfactant, in suitable proportions, will give a surfactant system having the desired softening point.

While any nonionic surfactant may be usefully employed in the present invention, two families of nonionics have been found to be particularly useful. These are nonionic surfactants based on alkoxylated (especially ethoxylated) alcohols, and those nonionic surfactants based on amidation products of fatty acid esters and N-alkyl polyhydroxy amine. The amidation products of the esters and the amines are generally referred to herein as polyhydroxy fatty acid amides. Particularly useful in the present invention are mixtures comprising two or more nonionic surfactants wherein at least one nonionic surfactant is selected from each of the groups of alkoxylated alcohols and the polyhydroxy fatty acid amides.

Suitable nonionic surfactants include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Particularly preferred for use in the present invention are nonionic surfactants such as the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with an average of up to 25 moles of ethylene oxide per more of alcohol. Particularly preferred are the condensation products of alcohols having an alkyl group containing from about 9 to 15 carbon atoms with from about 2 to 10 moles of ethylene oxide per mole of alcohol; and condensation products of propylene glycol with ethylene oxide. Most preferred are condensation products of alcohols having an alkyl group containing from about 12 to 15 carbon atoms with an average of about 3 moles of ethylene oxide per mole of alcohol.

It is a particularly preferred embodiment of the present invention that the nonionic surfactant system also includes a polyhydroxy fatty acid amide component.

Polyhydroxy fatty acid amides may be produced by reacting a fatty acid ester and an N-alkyl polyhydroxy amine. The preferred amine for use in the present invention is N-(R1)—CH2(CH2OH)4—CH2—OH, where R1 is typically a alkyl, e.g. methyl group; and the preferred ester is a C12–C20 fatty acid methyl ester.

Methods of manufacturing polyhydroxy fatty acid amides have been described in WO 92 6073, published on 16th Apr., 1992. This application describes the preparation of polyhydroxy fatty acid amides in the presence of solvents. In a highly preferred embodiment of the invention N-methyl glucamine is reacted with a C12–C20 methyl ester. It also says that the formulator of granular detergent compositions may find it convenient to run the amidation reaction in the presence of solvents which comprise alkoxylated, especially ethoxylated (EO 3–8) C12–C14 alcohols (page 15, lines 22–27). This can directly yield nonionic surfactant systems which are preferred in the present invention, such as those comprising N-methyl glucosamide and C12–C14 alcohols with an average of 3 ethoxylate groups per molecule.

Nonionic surfactant systems, and granular detergents made from such systems have been described in WO 92 6160, published on 16th Apr., 1992. This application describes (example 15) a granular detergent composition prepared by fine dispersion mixing in an Eirich RV02 mixer which comprises N-methyl glucosamide (10%), nonionic surfactant (10%).

Both of these patent applications describe nonionic surfactant systems together with suitable manufacturing processes for their synthesis, which have been found to be suitable for use in the present invention. However, for the purposes of the present invention is necessary to minimise (and preferably exclude) the presence of water (or other solvents) in order to achieve the required viscosity profile of the surfactant system of the present invention.

Other nonionic surfactants which may be used as components of the surfactant systems herein include ethoxylated nonionic surfactants, glycerol ethers, glucosamides, glycerol amides, glycerol esters, fatty acids, fatty acid esters, fatty amides, alkyl polyglucosides, alkyl polyglycol ethers, polyethylene glycols, ethoxylated alkyl phenols and mixtures thereof.

The surfactant system may also comprise anionic surfactants, indeed the inclusion of such surfactants may be of considerable advantage in order to improve the rate of solubility of the granular surfactant.

Anionic Surfactants

The laundry detergent compositions of the present invention can contain, in addition to the nonionic surfactant system of the present invention, one or more anionic surfactants as described below.

Alkyl Ester Sulfonate Surfactant

Alkyl Ester sulfonate surfactants hereof include linear esters of $C_8$–$C_{20}$ carboxylic acids (i.e. fatty acids) which are sulfonated with gaseous $SO_3$ according to "The Journal of the American Oil Chemists Society'" 52 (1975), pp. 323–329. Suitable starting materials would include natural fatty substances as derived from tallow, palm oil, etc.

The preferred alkyl ester sulfonate surfactant, especially for laundry applications, comprises alkyl ester sulfonate surfactants of the structural formula:

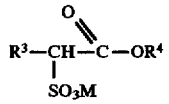

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl Sulfate Surfactant

Alkyl sulfate surfactants hereof are water soluble salts or acids or the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl Alkoxylated Sulfate Surfactant

Alkyl alkoxylated sulfate surfactants hereof are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl ether (1.0) sulfate, $C_{12}$–$C_{18}$ alkyl ether (2.25) sulfate, $C_{12}$–$C_{18}$ alkyl ether (3.0) sulfate, and $C_{12}$–$C_{18}$ alkyl ether (4.0) sulfate, wherein the counterion is conveniently selected from sodium and potassium.

Other Anionic Surfactants

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); methyl ester sulphonates (MES); acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside, branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 3% to about 20% by weight of such anionic surfactants.

Other Surfactants

The laundry detergent compositions of the present invention may also contain cationic, ampholytic, zwitterionic, and semi-polar surfactants.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)y][R^4(OR^3)y]_2R^5N^+X^-$$

wherein R2 is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2COH—CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

When included therein, the laundry detergent compositions of the present invention typically comprise from 0% to about 25%, preferably form about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched chain. One of the aliphatic substituents contains at least 8 carbon atoms, typically from about 8 to about 18 carbon atoms, and at least one contains an anionic water-solubilizing group e.g. carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

When included therein, the laundry detergent compositions of the present invention typically comprise form 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivates of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at columns 19, line 38 through column 22, line 48 (herein incorporated by reference) for examples of zwitterionic surfactants.

When included therein, the laundry detergent compositions of the present invention typically comprise form 0% to about 15% preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydrocyalkyl groups containing form about 1 to about 3 carbon atoms; water-soluble phosphine oxides containing one alkyl moiety of form about 10 to about 18 carbon atoms and 2 moieties selected form the group consisting of alkyl groups and hydroxyalkyl groups containing from about 1 to about 3 carbon atoms.

Semi-polar nonionic detergent surfactants include the amine oxide surfactants having the formula:

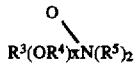

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is form 0 to about 3; and each $R^5$ is an alkyl or hydroxyalkyl group containing form about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

There amine oxide surfactants in particular include $C_{10}$–$C_{18}$ alkyl dimenthyl amine oxides and $C_8$–$C_{12}$ alkoxy ethyl dihydroxy ethyl amine oxides.

When included therein, the laundry detergent compositions of the present invention typically comprise form 0% to about 15%, preferably from about 1% to about 10% by weight of such semi-polar nonionic surfactants.

Normally the granular components and compositions will also contain other optional ingredients, such as builders, chelants (including phosphonic acids, succinic acids and their salts), bleaches, bleach activators (such as tetraacetylethylene diamine), polymers and co-polymers. Examples of such ingredients which are commonly used in detergents are given in more detail hereinbelow.

The detergent compositions herein can contain crystalline aluminosilicate ion exchange material of the formula $$Na_z[(AlO_2)_z.(SiO_2)_y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 5% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron.

Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27 and has a particle size generally less than about 5 microns.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali and alkaline earth metal, and especially sodium and magnesium, salts of the above are preferred. Sodium sulfate is typically used in detergent granules and is a particularly preferred salt. Citric acid and, in general, any other organic or inorganic acid may be incorporated into the granular detergents of the present invention as long as it is chemically compatible with the rest of the agglomerate composition.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhydroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate.

Suitable silicates are those having an $SiO_2$: $Na_2O$ ratio in the range from 1.6 to 3.4, the so-called amorphous silicates of $SiO_2$: Na2O ratios from 2.0 to 2.8 being preferred. These materials can be added at various points of the manufacturing process, such as in the form of an aqueous solution serving as an agglomerating agent for other solid components, or, where the silicates are themselves in particulate form, as solids to the other particulate components of the composition.

Within the silicate class, highly preferred materials are crystalline layered sodium silicates of general formula $$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2, 3 or 4 and is preferably 2. More preferably M is sodium and y is 0 and preferred examples of this formula comprise the γ and δ forms of $Na_2Si_2O_5$. These materials are available from Hoechst AG FRG as respectively NaSKS-11 and NaSKS-6. The most preferred material is δ -$Na_2Si_2O_5$, (NaSKS-6). Crystalline layered silicates are incorporated either as dry mixed solids, or as solid components of agglomerates with other components.

As mentioned above powders normally used in detergents such as zeolite, carbonate, silica, silicate, citrate, phosphate, perborate, percarbonate etc. and process acids such as starch and sugars, can be used in preferred embodiments of the present invention. Optionally, other components may be added at any one of the stages of the process of the present invention, or they may be mixed with or sprayed on to the granular detergents of the present invention.

Polymers which are particularly useful in the present invention include sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyvinyl pyrrolidone, polyethylene glycol, polyaspartate, polyacrylamides, polyacrylates and various copolymers, such as those of maleic and acrylic acids. Molecular weights for such polymers vary widely but most are within the range of 2,000 to 100,000.

Most preferred are polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Another optional detergent composition ingredient is a suds suppressor, exemplified by silicones, and silica-silicone mixtures. Silicones can be generally represented by alkylated polysiloxane materials while silica is normally used in finely divided forms, exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent-impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC0544, commercially available from Dow Corning, which is a siloxane/glycol copolymer.

The suds suppressors described above are normally employed at levels of from 0.001% to 0.5% by weight of the composition, preferably from 0.01% to 0.1% by weight.

The preferred methods of incorporation comprise either application of the suds suppressors in liquid form by spray-on to one or more of the major components of the composition or alternatively the formation of the suds suppressors into separate particulates that can then be mixed with the other solid components of the composition. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Another optional ingredient useful in the present invention is one or more enzymes.

Preferred enzymatic materials include the commercially available amylases, neutral and alkaline proteases, lipases, esterases and cellulases conventionally incorporated into detergent compositions. Suitable enzymes are discussed in U.S. Pat. Nos. 3,519,570 and 3,533,139.

Finished product compositions

The nonionic containing particles of the present invention can be effectively combined with other ingredients to form a multi-purpose granular detergent. In particular, the finished detergent composition should include detergent ingredients such as those described above. In finishing a product, the nonionic surfactant particles can be simply mixed with the rest of the ingredients that are in particulate form or in turn may be subjected to further process steps of spraying liquids and coating with fine powders.

While the performance of the particles described in the present invention remains excellent, independently of the rest of the product matrix, it is advantageous to finish the granular detergent composition in a way that maximises performance and permits high flexibility to the formulation of a wide variety of products without major process changes. This can be achieved by taking a modular approach to the building of the finished product matrix.

The modular approach is based on the manufacturing of particles highly specific in one or at most two ingredients of the formulation which are then mixed at the desired ratios to form the finished products. These particles, being highly specific in the ingredient they are to deliver, can be used in a wide range of products without need to be modified. These particles can be prepared with an optimal combination of ingredients that maximize their properties independently of full finished product formulations.

In particular, the nonionic surfactant particles described in the present invention, can be suitably complemented with one high activity anionic surfactant particle and at least one builder particle.

The ability to manufacture high activity nonionic and anionic particles separately allows their use at different ratios in different formulations. The high activity of these particles allow their preparation with a minimum amount of process aids, which are typically inorganic builders such as zeolites, carbonates, silicates, etc. Therefore, in a typical household granular detergent composition, there is room to be able to incorporate one or more highly specific builder particles by dry mixing. The presence of builder particles that dissolve independently from the surfactants, and which preferably have a more rapid rate of solution than the principle particles which contain the surfactants, is preferred. This improves the rate of alkalinity release to the wash and reduces the potential precipitation of the surfactants with salts of calcium or magnesium present in hard water.

Processing

The nonionic surfactant containing particles of the present invention may be prepared by:

a) pumping a surfactant system in its low viscosity state;
b) cooling said nonionic surfactant to a temperature where its viscosity is increased to at least 20000 cps;
c) granulating the surfactant in the presence of a finely divided powder;
d) cooling said agglomerates.

Each of these process steps will now be described in more detail.

The surfactant system may be pumped using any conventional pumping means. However one preferred means of pumping is to use an extruder. The extruder fulfils the functions of pumping and mixing the surfactant system on a continuous basis. A basic extruder consists of a barrel with a smooth inner cylindrical surface. Mounted within this barrel is the extruder screw. There is an inlet port for the surfactant system which, when the screw is rotated, causes the surfactant system to be moved along the length of the barrel.

The detailed design of the extruder allows various functions to be carried out. Additional ports in the barrel may allow other ingredients, including co-surfactants and/or chemical structuring agents to be added directly into the barrel. Secondly means for heating or cooling may be installed in the wall of the barrel for temperature control. Thirdly, careful design of the extruder screw promotes mixing of the paste both with itself and with other additives.

A preferred extruder is the twin screw extruder. This type of extruder has two screws mounted in parallel within the same barrel, which are made to rotate either in the same direction (co-rotation) or in opposite directions (counter-rotation). The co-rotating twin screw extruder is the most preferred piece of equipment for use in this invention. An extruder is particularly useful in this invention because the paste can be effectively cooled by adding liquid nitrogen or solid carbon dioxide into the barrel and at the same time pumps the increasingly viscous (colder) paste out of the extruder.

Suitable twin screw extruders for use in the present invention include those supplied by: APV Baker, (CP series); Werner and Pfleiderer, (Continua Series); Wenger, (TF Series); Leistritz, (ZSE Series); and Buss, (LR Series).

The surfactant system is transferred from the pumping means into a cooling means. The means for cooling may be any type of conventional heat exchanger. The surfactant system is introduced into the heat exchanger at a temperature above its softening point, and then cooled to a temperature close to, or even below its softening point with a resulting sharp increase in viscosity.

The cooling step (b) is preferably performed using a high pressure scraped surface heat exchanger. Such a piece of equipment is the Chemetator (Trade Name), manufactured by Crown Chemtech Ltd., Reading, England; and the Fryma (Trade Name), manufactured by Fryma Maschinen A. G., Reinfelden, Switzerland.

If a very short residence time is achieved in the heat exchanger (less than 60 seconds, preferably less than 30 seconds), shock cooling or supercooling can be achieved. In this way the paste stays in a liquid form even at temperatures below its softening point for a short period of time. The allows very high active agglomerates to be produced.

The viscous surfactant system is then granulated with suitable powders (step (c)). Many processes for granulating surfactant pastes are known to the man skilled in the art. A process which is suited to the present invention is that of fine dispersion mixing or agglomeration. In this process a finely dispersed viscous surfactant system is contacted with a finely divided powder which causes the powder to stick together (or agglomerate). Normally a blend of powders is present in the granulation step, in which case not all of the powders need to be finely divided. The result is a granular composition which generally has a particle size distribution in the range of 250 to 1200 micrometers and has a bulk density of at least 650 g/l. In the present invention the viscous surfactant system is used as the paste which is finely dispersed with an effective amount of powder in a suitable mixer. Suitable mixers for carrying out the fine dispersion mixing are described in more detail below. Any suitable powder may be chosen by mixing one or more of the ingredients listed above which may be conveniently handled in powder form. Powders comprising zeolite, carbonate, silica, silicate, sulphate, phosphate, citrate, citric acid and mixtures of these are particularly preferred.

The transfer of the viscous surfactant system from the heat exchanger into the mixer can be done in many ways, from simply pouring to high pressure pumping through small holes at the end of the pipe, before the entrance to the mixer. While all these ways are viable to manufacture agglomerates with good physical properties, it has been found that in a preferred embodiment of the present invention the extrusion of the paste through a die results in a better distribution in the mixer which improves the yield of particles with the desired size.

Preferred operating temperatures should also be as low as possible since this leads to a higher surfactant concentration in the finished particle. Preferably the temperature during the agglomeration is less than 80° C., more preferably between 0° C. and 70° C., even more preferably between 10° and 60° C. and most preferably between 20° and 50° C. Lower operating temperatures useful in the process of the present invention may be achieved by a variety of methods known in the art such as nitrogen cooling, cold water jacketing of the equipment, addition of solid CO2, and the like; with a preferred method being solid CO2, and a most preferred method being nitrogen cooling.

Suitable pieces of equipment in which to carry out the fine dispersion mixing or granulation of the present invention are mixers of the Fukae® FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention include Diosna® V series ex Dierks & Söhne, Germany; and the Pharma Matrix® ex T K Fielder Ltd., England. Other mixers believed to be suitable for use in the process of the invention are the Fuji® VG-C series ex Fuji Sangyo Co., Japan; and the Roto® ex Zanchetta & Co srl, Italy.

Other preferred suitable equipment can include Eirich®, series RV, manufactured by Gustau Eirich Hardheim, Germany; Lödige®, series FM for batch mixing, series Baud KM for continuous mixing/agglomeration, manufactured by Lödige Machinenbau GmbH, Paderborn Germany; Drais® T160 series, manufactured by Drais Werke GmbH, Mannheim Germany; and Winkworth® RT 25 series, manufactured by Winkworth Machinery Ltd., Berkshire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

The granulated surfactant particles are then allowed to cool to ambient temperatures. This may be most effectively achieved in a fluid bed cooler.

Further Processing Steps

The granular components or compositions described above may be suitable for use directly, or they may be treated by additional process steps. Commonly used process steps include drying, cooling and/or dusting the granules with a finely divided flow aid. In addition the granules may be blended with other components in order to provide a composition suitable for the desired end use as has been described above.

Any type of mixer or dryer (such as fluid bed dryers) may be found to be suitable for this purpose. The finely divided flow aid, if used, may be chosen from a wide variety of suitable ingredients such as zeolite, silica, talc, clay or mixtures of these.

EXAMPLES

In the following examples the abbreviation: C25E3 stands for a C12–C15 primary alcohol condensed with an average of 3 moles of ethylene oxide; C28AS stands for alkyl sulphate with a carbon chain length principally from C12 to C18. PEG4000 stands for polyethylene glycol having an average molecular weight of 4000.

Example 1

High active nonionic surfactant particulate compositions were prepared in batch mode using a pilot plant scale high shear mixer, an Eirich RVO2. The mixer was first charged with a mixture of powders, namely, Zeolite A, Alkyl Sulphate powder (having a carbon chain length distribution of C12 to C18), finely divided sodium carbonate and PEG4000. A surfactant system in the form of a nonionic surfactant paste consisting of a homogeneous mixture of 1 part ethoxylated nonionic surfactant and 1 part polyhydroxy fatty acid amide (Palm Glucosamide), was then added on top of the powder mixture while the mixer was being operated at 1600 rpm. Paste was added until discrete granules were formed in the mixer. The agglomerates where then transferred to a rotating drum mixer and dusted for 1–2 minutes with a flow aid at a level of 3% by weight of the granular detergent. The flow aid was a blend of 30 parts zeolite with 1 part hydrophobic silica. The compositions of the agglomerates are given below in Table 1.

TABLE 1

| | Composition 1A % by weight | Composition 1B % by weight |
|---|---|---|
| Polyhydroxy fatty acid amide | 18 | 19 |
| Nonionic surfactant (C25E3) | 18 | 19 |
| Sodium Alkyl Sulphate | 18 | 20 |
| Sodium Carbonate | 27 | 21 |
| Zeolite | 8 | 18 |
| Poly ethylene glycol (MW = 4000) | 8 | |
| Flow aid (Zeolite/Hydrophobic silica) | 3 | 3 |

The resulting agglomerates were made with a total surfactant activity of 54% and 58% respectively and showed good cake strength and compression values, and dissolved rapidly in water.

Example 2

The process of example 1 was repeated to provide the following composition (see table 2):

TABLE 2

| | % by weight |
|---|---|
| Polyhydroxy fatty acid amide | 20 |
| Nonionic surfactant (C25E3) | 20 |
| Sodium Carbonate | 30 |
| Zeolite | 27 |
| Flow aid (Zeolite/Hydrophobic silica) | 3 |

The resulting agglomerates were made with a total surfactant activity of 40% and showed good cake strength and compression value. Although the rate of dissolution in water was still acceptable, it was not as rapid as the composition of example 1 under comparable conditions.

Comparative example 3

This example describes the process in batch mode in a pilot plant scale high shear mixer as used in example 1. The mixer was first charged with a mixture of powders namely Zeolite A and finely divided sodium carbonate. A surfactant system in the form of a nonionic surfactant paste consisting of a homogeneous mixture of 1 part ethoxylated nonionic surfactant and 3 parts of polyhydroxy fatty acid amides (Tallow Glucosamide), was then added on top of the powder mixture while the mixer was being operated at 1600 rpm. The following composition was made (see table 3): The surfactant system has a high softening point, greater than 100° C.

TABLE 3

| | % by weight |
|---|---|
| Polyhydroxy fatty acid amide | 30 |
| Nonionic surfactant (C25E3) | 10 |
| Sodium Carbonate | 30 |
| Zeolite | 27 |
| Flow aid (Zeolite/Hydrophobic silica) | 3 |

The resulting agglomerates were made with a total surfactant activity of 40% and showed good cake strength and compression values. However the rate of dissolution of this composition was considerably slower than either of examples 1 or 2

Comparative example 4

This example describes the process in batch mode in a pilot plant scale high shear mixer as used in example 1. The mixer was first charged with a mixture of powders to be used, namely Zeolite A and finely divided sodium carbonate. A surfactant system in the form of a nonionic surfactant paste consisting of a homogeneous mixture of 3 parts ethoxylated nonionic surfactant and 1 part polyhydroxy fatty acid amides (Tallow Glucosamide), was then added on top of the powder mixture while the mixer was being operated at 1600 rpm. The surfactant system had a softening point of 40° C. and a viscosity of only 13000 cps at a temperature just above that softening point (viscosity measured at a shear rate of 25 $s^{-1}$). The following composition was made (see table 4):

TABLE 4

| | % by weight |
|---|---|
| Polyhydroxy fatty acid amide | 7 |
| Nonionic surfactant (C25E3) | 21 |
| Sodium Carbonate | 35 |
| Zeolite | 34 |
| Flow aid (Zeolite/Hydrophobic silica) | 3 |

The resulting agglomerates were made with a total surfactant activity of 28% and showed higher cake strength and compression values. Although this composition has a rapid rate of dissolution, the total surfactant activity achieved is lower than either of examples 1 or 2.

Comparative example 5

This example describes the process in batch mode in a pilot plant scale high shear mixer as used in example 1. The mixer was first filled with a mixture of powders to be used, in this particular case Zeolite A and fine sodium carbonate. A nonionic surfactant paste of polyhydroxy fatty acid amides (Tallow Glucosamide) with a softening point of 148° C. (in this case the softening point is a true melting point), was then added on top of the powder mixture while the mixer was being operated at 1600 rpm. The following composition was made (see table 5):

TABLE 5

| | % by weight |
|---|---|
| Polyhydroxy fatty acid amide | 40 |
| Sodium Carbonate | 30 |
| Zeolite | 27 |
| Flow aid (Zeolite/Hydrophobic silica) | 3 |

The resulting agglomerates were made with a total surfactant activity of 40% and showed high cake strength and compression values. However the rate of dissolution of this composition was considerably slower than either of examples 1 or 2.

Example 6

This example describes the process in batch mode in a pilot plant scale high shear mixer as used in example 1. The mixer was first charged with a mixture of powders to be used, namely Zeolite A, finely divided citrate and finely divided sodium carbonate. Anionic surfactant agglomerates were separately prepared by granulating a 78% active surfactant paste (4 parts alkyl sulphate, C14–C15 and 1 part alkyl ether sulphate, C13–C15 with an average of 3 ether groups per molecule) with a powder mixture of zeolite, carbonate, CMC, acrylic-maleic co-polymer. 22 parts of surfactant paste, 11 parts of zeolite, 9 parts of carbonate, 1 part of CMC and 5 parts of co-polymer were used and the resulting agglomerates were ground and sieved through mesh 250 microns. These fine anionic surfactant agglomerates were then added together with a surfactant system in the form of nonionic surfactant paste on top of the powder mixture while the mixer was operating at 1600 rpm. The nonionic surfactant paste consisting of 1 part ethoxylated nonionic surfactant and 1 part polyhydroxy fatty acid amides (Palm Stearine Glucosamide). The nonionic surfactant paste was cooled from 70° to 55° C. and extruded from a high pressure scraped surface heat exchanger. The following composition was made (see table 6):

TABLE 6

| | % by weight |
|---|---|
| Polyhydroxy fatty acid amide | 19 |
| Nonionic surfactant (C25E3) | 19 |
| Sodium Carbonate | 13 |
| Zeolite | 13 |
| Citrate | 13 |
| Fine anionic agglomerates | 20 |
| Flow aid (Zeolite/Hydrophobic silica) | 3 |

The agglomerates show excellent handling properties and rate of surfactant release.

Example 7

A surfactant system was prepared by thorough mixing of two nonionic surfactants; namely, 50% by weight palm stearine (C16–C18) glucosamide (GA) with 50% by weight of C12–C15 alkyl ether sulphate (having an average of 3 ether groups per mole), C25E3.

The surfactant system had a softening point at 50° C., and viscosities of 25000 cps at 60° C., and 100 cps at 70° C.

The surfactant system was cooled from 70° C. to 60° C. and then granulated with a mixture of particulate materials to give the following composition:

| | % by weight |
|---|---|
| Nonionic surfactant (GA/C25E3) | 40 |
| C12–C28 alkyl sulphate powder | 10 |
| Zeolite A | 20 |
| Citrate | 20 |
| Polyethylene glycol (MW = 4000) | 5 |
| Water and miscellaneous | 5 |

Example 8

Example 7 was repeated replacing the palm stearine glucosamide by tallow stearine glucosamide.

The surfactant system had a softening point at 65° C., and viscosities of 25000 cps at 75° C., and 100 cps at 85° C.

The surfactant system was cooled from 85° C. to 45° C. using a high pressure scraped surface heat exchanger. The short residence time (10 seconds) in the heat exchanger results in the surfactant system remaining liquid for a short period of time even below the solidification point. Granulation was then carried out with a mixture of particulate materials in a Braun food processor to give the following compositions:

| | Ex. 8A % by weight | Ex. 8B % by weight |
|---|---|---|
| Nonionic surfactant (GA/C25E3) | 50 | 50 |
| C12–C28 alkyl sulphate powder | — | 15 |
| Zeolite A | 25 | 20 |
| Carbonate | 25 | 15 |

Example 9

The process of example 8 was repeated using a die at the outlet of the heat exchanger to form noodles or extrudates of the surfactant system. The following composition was produced:

| | % by weight |
|---|---|
| Nonionic surfactant (GA/C25E3) | 60 |
| C12–C28 alkyl sulphate powder | 20 |
| Zeolite A | 10 |
| Carbonate | 10 |

The compositions of examples 7 to 9 showed good cake strength and compression values, and dissolved rapidly in water.

Example 10

High active nonionic surfactant particulate compositions were prepared in a batch mode using a pilot plant scale mixer, an Eirich RVO2. The mixer was charged with a mixture of powders, namely zeolite A, Alkyl Sulphate powder, and finely divided sodium carbonate. Molten dodecyl glycerol ether was added on top of the powder while the mixer was being operated at 1200 rpm. The nonionic surfactant was added until discrete granules were formed. This viscosity of the dodecyl glycerol ether was 20,000 cps at 60° C. but 4000 cps at 80° C. The composition was:

| | % by weight |
|---|---|
| Dodecyl Glycerol Ether | 40% |
| Alkyl Sulphate | 10% |
| Sodium Carbonate | 25% |
| Zeolite | 25% |

The agglomerates had a total surfactant activity of 50% and showed good cake strength and compression values.

Example 11

A finished laundry detergent was put together by blending the following components:

| | % by weight |
|---|---|
| a) Nonionic surfactant agglomerate | 13.4 |
| b) Anionic surfactant agglomerate | 32.5 |
| c) Layered Silicate compacted granule | 10.1 |
| d) Granular Percarbonate | 22.7 |
| e) Teatraacetylethylene diamine agglomerate | 7.8 |
| f) Suds Suppressor Agglomerate | 6.5 |
| g) Perfume encapsulate | 0.1 |
| h) Granular Soil Release Polymer | 0.4 |
| i) Granular Sodium Citrate dihydrate | 3.5 |
| j) Enzymes | 3.0 |

Component a) was prepared according to the composition and process described in Example 1A above.

Component b) was prepared from an anionic surfactant paste having the following composition, the separate ingredients being mixed in aqueous form and subsequently dried to the required water level:

| | |
|---|---|
| alkyl sulphate (C14–C15) | 57.2 |
| alkyl ether sulphate (C13–C15 with 3 EO) | 14.3 |
| acrylic-maleic copolymer | 16 |
| sodium ethylenediamine-N,N'-disuccinic acid | 1.5 |
| water | 11 |

The anionic surfactant paste was maintained at 60° C. and added to an Eirich RVO2 mixer, operating at 1600 rpm with the following powder composition:

| | |
|---|---|
| zeolite A | 14 |
| light soda ash | 75 |
| Carboxymethyl cellulose | 4 |
| Magnesium sulphate | 4 |
| Water | 3 |

Sufficient surfactant paste was added to the mixer until discrete particles, having an average particle size of about 500 micrometers were obtained. The particles were then dried in a fluid bed dryer to an equilibrium relative humidity of 10% at 20° C.

The final particulate composition of component b) contained 53% anionic surfactant and had a bulk density of 710 g/l.

Component c), the layered silicate compact granule, was prepared from powder layered silicate 2.0 ratio (SKS-6 trade name ex Hoechst), powder citric acid and ethoxylated tallow alcohol, TAE50 (average of 50 ether groups). The SKS-6 and the citric acid, both with an average particle size of about 150 microns were mixed together while sprayed with TAE50 in a rotating spray drum at the following composition:

77% SKS-6

21% anhydrous citric acid

2% TAE50

The mixture was then passed to the feed hopper of a roll compactor and was compacted into a flake. The flake was ground up to 600 microns average particle size. The oversize fraction was recycled back to the grinder and the fines fraction back to the compactor.

The particle prepared via this process reaches its maximum calcium exchange capacity at the pH of the wash in less than 2 minutes.

Components d) to j) were obtained from the following commercially available sources:

d) supplied by Interox; e) supplied by Warwick International; f) prepared according to U.S. Pat. No. 3,933,672; g) supplied by Haarman & Reimer; h) supplied by Hoechst; i) supplied by Jungbunzlauer; j) supplied by Novo Nordisk.

The finished composition was made by placing components a) to j) in a 120 liter rotating drum operating at 15 rpm. A mixture of nonionic surfactant and a 20% aqueous solution of optical brightener at ratios of 14:1 were sprayed at 55° C. on to the granular mixture to a level of 5% by weight of the finished product. The nonionic surfactant used consisted of a mixture of 7 parts of nonionic surfactant (C25E3) with 3 parts of palm stearine glucosamide.

Immediately afterwards, perfume was sprayed on at a level of 0.5%. Finally, without stopping the rotating drum, zeolite was slowly added to the drum to a level of 5% by weight of the finished product. The mixer was then continued for a further 30 seconds, and the product then discharged.

After two days of ageing the finished composition had a bulk density of 850 g/l. The particle size distribution was:

| Tyler Sieve no. | Micrometers | % by weight of product on sieve |
|---|---|---|
| 14 | 1180 | 17 |
| 20 | 850 | 39 |
| 35 | 425 | 88 |
| 65 | 212 | 99 |
| 100 | 150 | 99.5 |

The mean particle size of the finished product composition was about 720 micrometers.

The product prepared according to this example exhibits very high rates of dissolution of both anionic and nonionic surfactants. Furthermore the rate of alkalinity release (principally due to component c) was excellent.

Example 12

A homogeneous mixture of 2 parts polyhydroxy fatty acid amide (Palm Stearine Glucosamide) with 3 parts ethoxylated nonionic surfactant (C25E5) at 85° C. was mixed with a copolymer of acrylic-maleic acid. The paste was then cooled from 85 to 45° C. using a high pressure scraped surface heat exchanger. The viscosity of the cooled paste was greater than 20,000 cps. The cooled paste was immediately agglomerated with detergent powders in a Braun food processor. In this example the powders were alkyl sulphate, sodium carbonate and zeolite A. The resulting agglomerates had the following composition:

| | % by weight |
|---|---|
| Polyhydroxy fatty acid amide | 16 |
| Nonionic surfactant | 24 |
| Zeolite A (hydrated) | 20 |
| Carbonate | 15 |
| Sodium alkyl sulphate | 15 |
| Copolymer of acrylic-maleic acid | 10 |

The composition shows good cake strength and compression values and a high rate of surfactant release in water.

Example 13

This example describes the same process as used in example 12 but now some of the alkyl sulphate powder was premixed with the mixture of nonionic surfactants prior to cooling. A die was used at the outlet of the heat exchanger and therefore the paste was coming out as noodles or extrudates. The cooled paste was immediately agglomerated with detergent powders including a copolymer of acrylic-maleic acid in a Braun food processor. In this case the powders are Alkyl sulphate (C28AS), sodium carbonate and zeolite A.

| | % by weight |
|---|---|
| Polyhydroxy fatty acid amide | 20 |
| Nonionic surfactant | 30 |
| Alkyl Sulphate | 20 |
| Zeolite A (hydrated) | 10 |
| Carbonate | 10 |
| Copolymer of acrylic-maleic acid | 10 |

This example describes the same process as used in example 13 but a cooled twin screw extruder was used to premix the alkyl sulphate with the nonionic surfactant instead of a scraped surface heat exchanger.

Example 15

This example describes the process in batch mode in a pilot plant scale high shear mixer, an Eirich RVO2, to produce high active nonionic detergent agglomerates. The mixer was first charged with a mixture of powders to be used, in this example Zeolite A , Alkyl Sulphate (C28AS), fine citrate and fine sodium carbonate. A nonionic surfactant paste comprising a mixture of 1 part polyhydroxy fatty acid amides (Palm Stearine Glucosamide) with 2 parts ethoxylated nonionic surfactant (C25E5) was mixed with polyethyleneoxide (molecular weight=100 000). The paste was then added to the high shear mixer containing the powder mixture while the mixer was being operated at 1600 rpm. Enough paste was added until the granulation was achieved. The agglomerates were then transferred to a rotating drum mixer and dusted for 1–2 minutes with a flow aid at a level of 3% by weight of the granular detergent. The composition of the agglomerates is given below.

| | % by weight |
|---|---|
| Polyhydroxy fatty acid amide | 12 |
| Nonionic surfactant (C25E5) | 24 |
| Alkyl Sulphate | 20 |
| Sodium Carbonate | 14 |
| Zeolite A | 10 |

-continued

| | % by weight |
|---|---|
| Fine citrate | 10 |
| Polyethyleneoxide | 7 |
| Flow aid (ZeoliteA/Zeolite DAY) | 3 |

The resulting agglomerates were made with a total surfactant activity of 57% and showed good cake strength and compression values. The rate of nonionic surfactant release in water is comparable to example 12.

Example 16

A homogeneous mixture of 1 part Palm Stearine Glucosamide with 1 part ethoxylated nonionic surfactant (C25E5) at 90° C. was mixed with a molten Palmitic Acid, PEG 4000 and zeolite in a jacketed tank fitted with a mixing screw. The resultant mixture was fed into a continuous belt cooler and produced into flakes. The flakes had the following composition:

| | % by weight |
|---|---|
| Polyhydroxy fatty acid amide | 20 |
| Nonionic surfactant | 20 |
| Palmitic Acid | 10 |
| Zeolite | 30 |
| PEG 4000 | 10 |
| Alkyl Sulphate | 10 |

The resulting flakes were ground up to average particle size of 200 microns in a pin disk mill using 5% zeolite A as a flow aid. The resulting powders showed good cake strength and compression values. The rate of nonionic surfactant release in water is comparable to example 12.

Example 17

A homogeneous mixture of 3 parts Palm stearine Glucosamide and 7 parts ethoxylated nonionic surfactant (C25E5) was cooled in a Scraped Wall Cooler (Chemitator®) to 45° C. and mixed with powdered Alkyl Polyglucoside in a twin screw extruder. The resulting mixture had a viscosity of greater than 20,000 cps. The mixture was then agglomerated in batch mode in a pilot plant scale high shear mixer, an Eirich RVO2. The mixer was first charged with a mixture of powders to be used, in this particular case Zeolite P, fine citrate and water as a binder, and then the surfactant mixture was added to the mixture to produce nonionic detergent agglomerates.

| | % by weight |
|---|---|
| Polyhydroxy fatty acid amide | 10 |
| Nonionic surfactant | 23 |
| APG | 12 |
| Zeolite P | 25 |
| Citrate | 25 |
| moisture | 5 |

The resulting agglomerates were made with a total detergent activity of 45% and showed good cake strength and compression values. The rate of nonionic surfactant release in water is comparable to example 12.

What is claimed is:

1. A process for making granular detergent compositions or components from a surfactant system which is in the solid phase at temperatures of 25° C. and below, wherein said surfactant system has a softening point from above 25° C. to 100° C. and wherein the surfactant system has a viscosity profile whereby the viscosity of the surfactant system is at least about 20000 cps at a temperature of 10° C. above the softening point, and less than about 10000 cps at a temperature of 30° C. above the softening point, all viscosities being measured at a shear rate of 25 $s^{-1}$, said process comprising the steps of:

a) pumping a surfactant system in its low viscosity state said surfactant system comprising a mixture of polyhydroxy fatty acid amide and ethoxylated nonionic surfactant;

b) cooling said surfactant system to a temperature where its viscosity is increased to at least about 20000 cps;

c) granulating the surfactant system in the presence of a finely divided powder to obtain agglomerates; and d) cooling said agglomerates, wherein the agglomerates comprise from about 35% to about 85% by weight of the surfactant system.

2. A process according to claim 1 wherein cooling step (b) is performed using a high pressure scraped surface heat exchanger.

3. A process according to claim 1 wherein said surfactant system has a softening point which lies within the range of from about 40° C. to about 100° C.

4. A process according to claim 1 wherein said surfactant system has a viscosity profile whereby the viscosity of the surfactant system is from about 25000 to about 50000 cps at a temperature of 10° C. above the softening point.

5. A process according to claim 1 wherein said surfactant system further comprises an anionic surfactant, said anionic surfactant and said mixture having a weight ratio of from about 1:100 to about 1:1.

6. A process according to claim 1 wherein said surfactant system has a water component of less than about 15% by weight of the surfactant system.

7. A process according to claim 6 wherein said surfactant system has a water component of less than about 10% by weight of the surfactant system.

8. A process according to claim 1 wherein said polyhydroxy fatty acid amide and ethoxylated nonionic surfactant have a weight ratio of from about 3:7 to about 7:3.

9. A process according to claim 1 wherein said granular detergent composition or component comprises more than about 40% by weight of said surfactant system.

10. A process according to claim 9 wherein said granular detergent composition or component comprises more than about 50% by weight of said surfactant system.

11. A process according to claim 1, wherein said agglomerates are mixed with second and third components wherein:

a) the second component comprises at least about 40% by weight of anionic surfactant; and b) the third component comprises at least about 70% by weight of a builder.

12. A process according to claim 11 wherein said granular detergent composition or component comprises:

from 3% to 40% by weight of the agglomerate comprising from about 35% to about 85% by weight of said surfactant system;

from 3% to 40% by weight of a second component comprising at least about 40% by weight of anionic surfactant; and from 3% to 20% by weight of the third component comprising at least about 70% by weight of a builder.

* * * * *